United States Patent [19]

Malagari, Jr.

[11] Patent Number: 4,693,762

[45] Date of Patent: Sep. 15, 1987

[54] PROCESSING FOR CUBE-ON-EDGE ORIENTED SILICON STEEL

[75] Inventor: Frank A. Malagari, Jr., Freeport, Pa.

[73] Assignee: Allegheny Ludlum Corporation, Pittsburgh, Pa.

[21] Appl. No.: 763,885

[22] Filed: Aug. 8, 1985

Related U.S. Application Data

[63] Continuation of Ser. No. 510,844, Jul. 5, 1983, abandoned.

[51] Int. Cl.[4] ..... H01F 1/04

[52] U.S. Cl. ..... 148/111; 148/112; 148/308

[58] Field of Search ..... 148/110–113

[56] References Cited

U.S. PATENT DOCUMENTS

| | | | |
|---|---|---|---|
| 2,534,141 | 12/1950 | Morrill et al. | 148/111 |
| 3,207,639 | 9/1965 | Möbius | 148/113 |
| 3,930,906 | 1/1976 | Irie et al. | 148/113 |
| 3,940,299 | 2/1976 | Goto et al. | 148/111 |
| 4,127,429 | 11/1978 | Ichida et al. | 148/113 |
| 4,157,925 | 6/1979 | Malagari et al. | 148/111 |
| 4,212,689 | 7/1980 | Shimizu et al. | 148/111 |
| 4,318,758 | 3/1982 | Kuroki et al. | 148/111 |

OTHER PUBLICATIONS

The American Heritage Dictionary of the English Language, 1976, p. 695.

*Primary Examiner*—John P. Sheehan

[57] ABSTRACT

A method is provided for final texture annealing silicon steel to produce a cube-on-edge grain orientation having lower core losses and higher magnetic permeability. The method includes using a controlled heating cycle including a substantially isothermal hold at a selected recrystallization temperature of about 1650° F. to improve secondary recrystallization and the Goss texture (110) [001].

11 Claims, 4 Drawing Figures

PROCESSING FOR CUBE-ON-EDGE ORIENTED SILICON STEEL

This is a continuation of application Ser. No. 510,844, filed July 5, 1983, now abandoned.

BACKGROUND OF THE INVENTION

This invention relates to a final texture annealing cycle to promote improved secondary recrystallization. Particularly, the invention relates to a substantially isothermal anneal at a selected recrystallization temperature.

In the manufacture of grain-oriented silicon steel, it is known that if improved secondary recrystallization texture, e.g., Goss texture (110)[001], is achieved, the magnetic properties, particularly permeability and core loss, will be correspondingly improved. The Goss texture (110)[001], in accordance with Miller's indices, refers to the body-centered cubes making up the grains or crystals being oriented in the cube-on-edge position. The texture or grain orientations of this type refers to the cube edges being parallel to the rolling direction and in the plane of rolling, and the cube face diagonals being perpendicular to the rolling direction and in the rolling plane. As is well known, steel having this orientation is characterized by a relatively high permeability in the rolling direction and a relatively low permeability in a direction at right angles thereto.

The development of a cube-on-edge orientation is dependent upon a mechanism known as secondary recrystallization. During recrystallization, secondary cube-on-edge oriented grains are preferentially grown at the expense of primary grains having a different and undesirable orientation. The steel composition, particularly the impurity contents, the processing operations including hot rolling and the degree of deformation in each cold-rolling operation, intermediate and final continuous annealing time and temperature cycles, and the final texture annealing procedure must all be carefully controlled to attain the optimum texture development. A steel that has not obtained optimum texture development may have a substantially uniform but inadequate grain size and structure and resulting poor magnetic properties or may exhibit a "banding" of inferior grain structure. Generally, banding means areas or bands of inferior grain structure extending across the width of the coil surrounded by areas of well-textured steel. Generally, the initial phases of secondary recrystallization occur at about 1550° F. (843° C.), however, secondary grain growth proceeds much faster and more efficiently at temperatures of about 1600° F. (871° C.) or more. The operation through which the secondary grains are preferentially grown and consume the primary grains is known as final texture annealing.

In the manufacture of grain-oriented silicon steel, the typical steps include subjecting the melt of 2.5–4% silicon steel through a casting operation, such as a continuous casting process, hot rolling the steel, cold rolling the steel to final gauge with an intermediate annealing when two or more cold rollings are used, decarburizing the steel, applying a refractory oxide base coating to the steel, and final texture annealing the steel, such as in a hydrogen atmosphere, to produce the desired secondary recrystallization, and purification treatment to remove impurities, such as nitrogen and sulfur. The final texture annealing is typically performed at a temperature in excess of 2000° F. (1093° C.) and held for an extended time period of at least 4 hours and generally longer to remove impurities.

A typical thermal cycle of the final texture annealing practice may include a reasonably continuous heating rate of approximately 50° F./hour (27.8° C./hour) from the charge temperature of the coated strip to a temperature high enough to effect purification. The charge temperature in mill practice, typically, is on the order of room temperature of 80° F. (26.7° C.) or more and the purification temperature may range from 2000° F. (1093° C.) up to a maximum of about 2300° F. (1260° C.) and preferably up to 2250° F. (1232° C.). The steel is generally subjected to a soaking at the purification temperature to remove the impurities for a long time, typically on the order of about 20 hours at or higher than 2100° F. (1150° C.).

Numerous attempts by others have been made to improve the final texture. U.S. Pat. No. 2,534,141—Morrill et al discloses a two-stage final texture anneal to improve the orientation. First, the decarburized sheet is held for 4–24 hours at 850°–900° C. (1560°–1650° F.), and preferably at 875° C. (1605° F.), in a reducing or nonoxidizing atmosphere to encourage and permit nucleation of well-oriented crystals and their growth. Second, the steel is then held at a temperature at 900° to 1200° C. (1650°–2192° F.), and preferably 1175° C. (2147° F.) in a reducing atmosphere to permit completion of the growth of the well-oriented crystals and to relieve mechanical strain.

U.S. Pat. No. 4,157,925—Malagari et al discloses a process for producing a cube-on-edge orientation in a boron-inhibited silicon steel. The process includes heating the steel from a temperature of 1700° to 1900° F. (926° to 1038° C.) at an average rate of less than 30° F./hour (16.7° C./hour) so as to provide a minimum time period for the selective grain-growth process to occur and to final texture anneal the steel by heating to a temperature in excess of 2000° F. (1093° C.) and to a maximum temperature of 2300° F. (1260° C.) for purification of the steel.

U.S. Pat. No. 4,318,738—Kuroki et al discloses in Example 3 a method for producing grain-oriented silicon steel containing aluminum wherein the decarburized and coated sheet is heated up to 900° C. (1650° F.) in a 75% $H_2$ and 25% $N_2$ atmosphere with a heating rate of 20° C./hour (36° F./hour), then heating between 900° to 1050° C. (1650°–1922° F.) in the same atmosphere at a heating rate of 5° C./hour (9° F./hour), between 1050° and 1200° C. (1922°–2192° F.) in 100% $H_2$ atmosphere at a heating rate of 20° C./hour (36° F./hour) where the steel is maintained at 1200° C. (2192° F.) for 20 hours in the 100% $H_2$ atmosphere.

None of these patents disclose the present invention. What is needed is an improved final texture annealing process wherein improved cube-on-edge orientation of the secondary grains may be achieved during secondary recrystallization to result in improved permeability and core loss values. The improved final texture annealing process should include control of the heating cycle and result in improved productivity as measured by an overall improvement in quality.

It is known that variations occur in magnetic properties within a given coil of silicon steel. The variations can be measured by taking samples from the coil ends and measuring the core loss values of those samples. A convenient measure of quality improvement is the percentage of coils having a poor end core loss at 60 Hz equal to or less then 0.714 WPP at 17 KG (1.57 WPKg at 1.7 Tesla). It is desirable to improve productivity so that an increasing percentage, and preferably the majority, of the coils produced satisfy minimum core loss values, such as that above.

It is also an objective to develop a process which substantially eliminates the "banding" problem.

SUMMARY OF THE INVENTION

In accordance with the present invention, a process is provided for producing electromagnetic silicon steel having cube-on-edge orientation wherein the process includes the conventional steps of preparing a steel melt containing 2.5–4% silicon, casting the steel, hot rolling the steel, cold rolling the steel to final gauge, decarburizing the steel, applying a refractory oxide base coating to the steel, and final texture annealing the steel by heating to and maintaining at a temperature in excess of 2000° F. The improvement comprises heating the steel during the final texture annealing to a selected recrystallization temperature within the range of 1600° to 1700° F., substantially isothermally heating the steel at that temperature for about 6 to 20 hours to substantially complete secondary recrystallization, and heating the steel from that substantially isothermal hold temperature to a temperature in excess of 2000° F. to effect purification.

DETAILED DESCRIPTION OF THE PREFERRED EMBODIMENTS

Figure 1A:
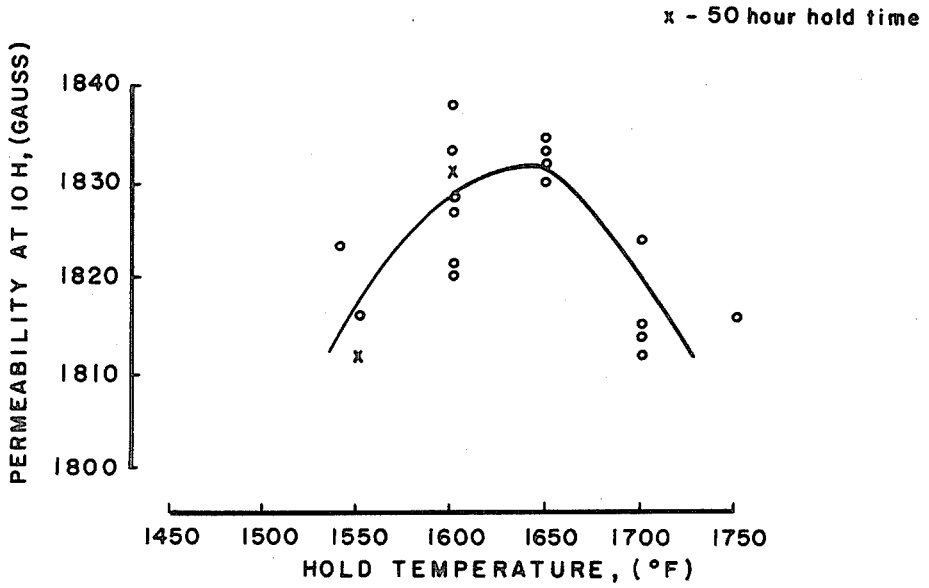
FIGS. 1*a* and 1*b* are plots of core loss and permeability, respectively, versus hold temperature for 11-mil steel.

The final texture annealing process of the present invention includes a controlled heating cycle wherein the steel is substantially isothermally annealed at selected temperatures for particular periods of time to effect substantially complete secondary recrystallization. As used herein, substantially isothermal heating or annealing during recrystallization means heating at a very low heating rate. The heating rate need not be zero, but preferably should be less then about 10° F./hour (5.5° C./hour), and more preferably less than 5° F./hour (2.8° C./hour). As a practical consideration, it is difficult to isothermally hold at a particular temperature in a production furnace, but very small variations in heating rate about a selected recrystallization temperature is within the scope of the invention. Most preferably such an isothermal hold shall mean a heating rate of less than 5° F./hour.

Specific processing of the steel up to final texture annealing may be conventional and is not critical to the present invention. The specific processing may include a number of conventional steps which include preparing a melt of the steel, casting the steel, hot rolling the steel, cold rolling the steel to final gauge with intermediate annealing steps, decarburizing the steel, applying a refractory oxide base coating, and then final texture annealing the steel in excess of 2000° F.

Although the texture annealing method of the invention described in detail hereinafter has utility with grain-oriented silicon steel generally, the following typical composition is one example of a silicon steel composition adapted for use with the method of this invention:

| C | Mn | S | Cu | Si | Fe |
|---|---|---|---|---|---|
| 0.030 | 0.065 | 0.025 | 0.22 | 3.15 | Balance |

To illustrate the several aspects of the final texture annealing process of the present invention, various samples of a silicon steel having a composition similar to the above-described typical composition were process and the results of the tests are shown in the following Table I.

TABLE I

| Sample Group | No. of Samples | Hold Temp. (°F.) | Hold Time (Hrs.) | Average WPP at 17 KG | Average μ at 10 H (Gauss) |
|---|---|---|---|---|---|
| A | 18 | None | — | .754 | 1812 |
| B | 25 | None | — | .746 | 1820 |
| C | 25 | None | — | .726 | 1819 |
| D | 25 | 1600 | 6 | .706 | 1833 |
| E | 25 | 1650 | 6 | .711 | 1830 |
| F | 25 | 1700 | 6 | .728 | 1824 |
| G | 25 | 1750 | 6 | .736 | 1816 |
| H | 17 | None | — | .730 | 1821 |
| I | 17 | 1460 | 6 | .724 | 1828 |
| J | 17 | 1540 | 6 | .724 | 1823 |
| K | 17 | 1650 | 6 | .706 | 1834 |
| L | 17 | 1600 | 6 | .719 | 1828 |
| M | 17 | 1600 | 12 | .717 | 1827 |
| N | 15 | None | — | .727 | 1820 |
| O | 15 | 1550 | 12 | .731 | 1816 |
| P | 15 | 1600 | 6 | .737 | 1820 |
| Q | 15 | 1650 | 6 | .718 | 1832 |
| R | 15 | 1700 | 12 | .736 | 1815 |
| S | 11 | 1600 | 50 | .707 | 1831 |
| T | 15 | 1550 | 50 | .744 | 1812 |
| U | 15 | 1600 | 6 | .731 | 1821 |
| V | 15 | 1600 | 20 | .695 | 1838 |
| W | 15 | 1650 | 6 | .703 | 1833 |
| X | 15 | 1650 | 20 | .708 | 1832 |
| Y | 15 | 1700 | 6 | .740 | 1812 |
| Z | 15 | 1700 | 20 | .738 | 1814 |
| AA | 15 | 1550 | 12 | .731 | 1816 |
| BB | 15 | 1600 | 12 | .717 | 1833 |
| CC | 15 | 1650 | 12 | .709 | 1837 |
| DD | 15 | 1700 | 12 | .736 | 1815 |

All the Sample Groups of Table I were obtained from various heats of nominally 11-mil gauge silicon steel having the above-identified typical composition. The samples were all coated with MgO slurry and heated from a charge temperature at a relatively constant heating rate of about 50° F./hour (27.7° C./hour) or greater. Groups D-G and I-M and O-DD were all heated from charge temperature up to the specified hold temperature. Sample Groups A, B, C, H and N were not isothermally annealed and so were not held at any temperature, but were heated from the charge temperature up to a purification soak temperature. All the Sample Groups were texture annealed in a hydrogen atmosphere at a soak temperature of 2150° F. (1177° C.). Groups A-Z were held at 2150° F. for 20 hours, and Groups AA-DD for 10 hours.

Figure 1B:
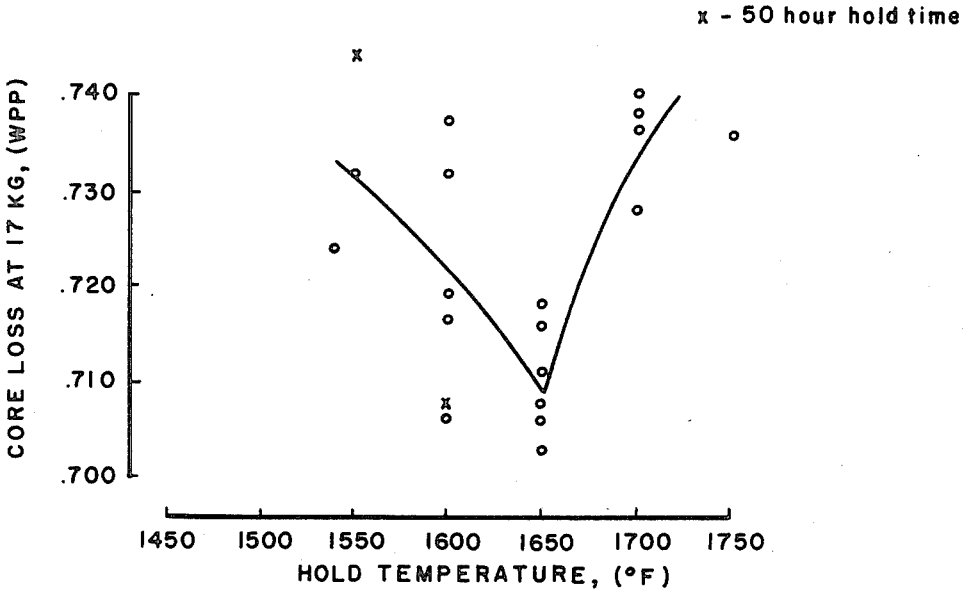

The magnetic properties listed in Table I represent an average value for core loss and permeability for the number of samples for that group. The distribution of 60 Hz core losses at 17 KG (1.7 Tesla) and permeability at 10 Oersteds for those samples are shown in FIGS. 1*a* and 1*b*.

The data show that generally the samples which were held for time at a temperature within the recrystallization range of 1600° to 1700° F. have improved properties over those samples not held at temperature (Samples A, B, C, H and N). The data demonstrate that annealed samples demonstrate incomplete recrystallization if the hold temperature is 1550° F. All samples were completely recrystallized at about 1650° F. hold temperature. The data also suggest that within the 1600°–1700° F. range, there may be a range of temperatures within which substantial recrystallization occurs so as to result in improved magnetic properties. The range of about 1600°–1650° F. is preferred.

The hold time for the isothermal anneal is also critical. Insufficient time results in incomplete recrystallization. Too much time will generally result in some deterioration of magnetic properties, as shown by Groups S and T at 50 hours hold time. Results of tests have shown that the hold times of 6 to 20 hours provide good properties with a practical preferred time being about 12 hours.

TABLE II

| Sample Group | No. of Samples | Hold Temp. (°F.) | Hold Time (Hrs.) | Average WPP at 17 KG | Average μ at 10 H (Gauss) |
|---|---|---|---|---|---|
| A | 25 | 1550 | 12 | .731 | 1808 |
| B | 25 | 1600 | 12 | .728 | 1808 |
| C | 25 | 1650 | 12 | .686 | 1853 |
| D | 25 | 1700 | 12 | .706 | 1829 |
| E | 6 | None | — | .738 | 1800 |
| F | 6 | 1650 | 12 | .682 | 1825 |
| G | 6 | 1550 | 12 | .733 | 1789 |
| H | 6 | 1550 | 50 | 1.010 | 1640 |
| I | 6 | 1650 | 50 | .681 | 1818 |
| J | 6 | 1600 | 50 | .796 | 1761 |
| K | 6 | 1700 | 12 | .693 | 1817 |
| L | 6 | 1600 | 12 | .716 | 1809 |
| M | 9 | 1600 | 12 | .717 | 1804 |
| N | 9 | 1650 | 40 | .675 | 1827 |
| O | 9 | 1650 | 40 | .662 | 1834 |
| P | 25 | 1550 | 12 | .726 | 1815 |
| Q | 25 | 1650 | 12 | .691 | 1851 |
| R | 25 | 1650 | 12 | .683 | 1838 |
| S | 25 | 1700 | 12 | .706 | 1829 |

All the Sample Groups of Table II were obtained from various heats of nominally 9-mil gauge silicon steel having the same nominal composition as for the 11-mil samples of Table I. The samples were all coated with MgO slurry and heated from a charge temperature at a relatively constant heating rate of about 50° F./hour (27.7° C./hour) or greater. All of the Sample Groups, except Group E, were heated from charge temperature up to the specified hold temperature. Sample Group E was not isothermally annealed and so was not held at temperature, but was heated from the charge temperature up to a purification soak temperature. All the Sample Groups were texture annealed in a hydrogen atmosphere at a soak temperature of 2150° F. (1177° C.) and held for 10 hours.

Figure 2A:
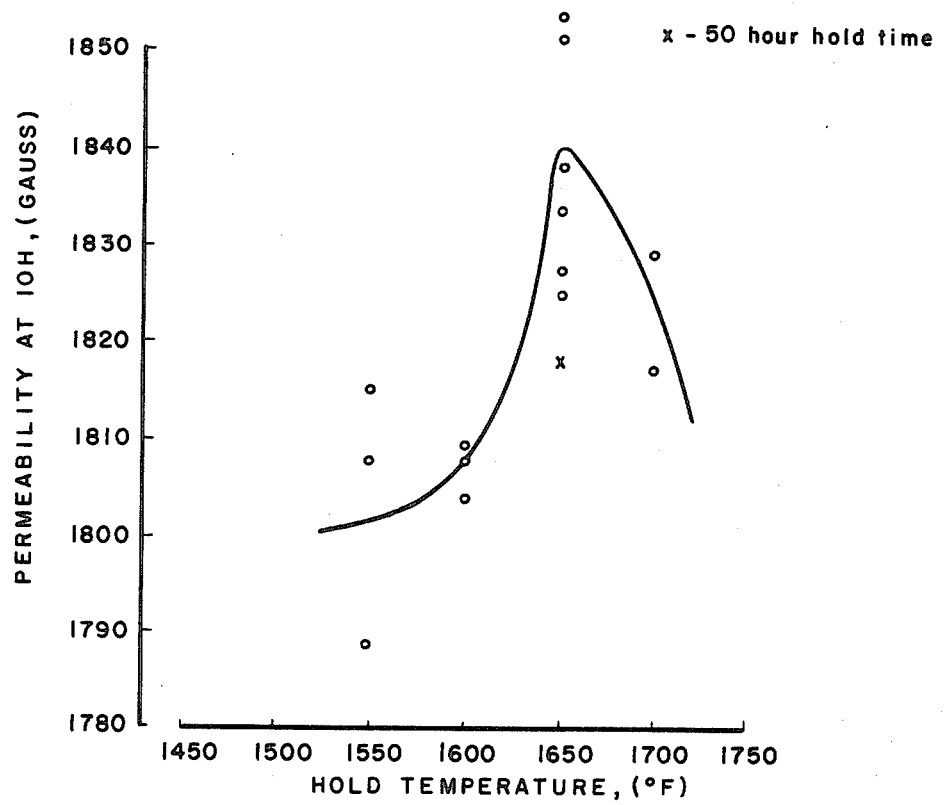
FIGS. 2*a* and 2*b* are plots of core loss and permeability, respectively, versus hold temperature for 9-mil steel.
Figure 2B:
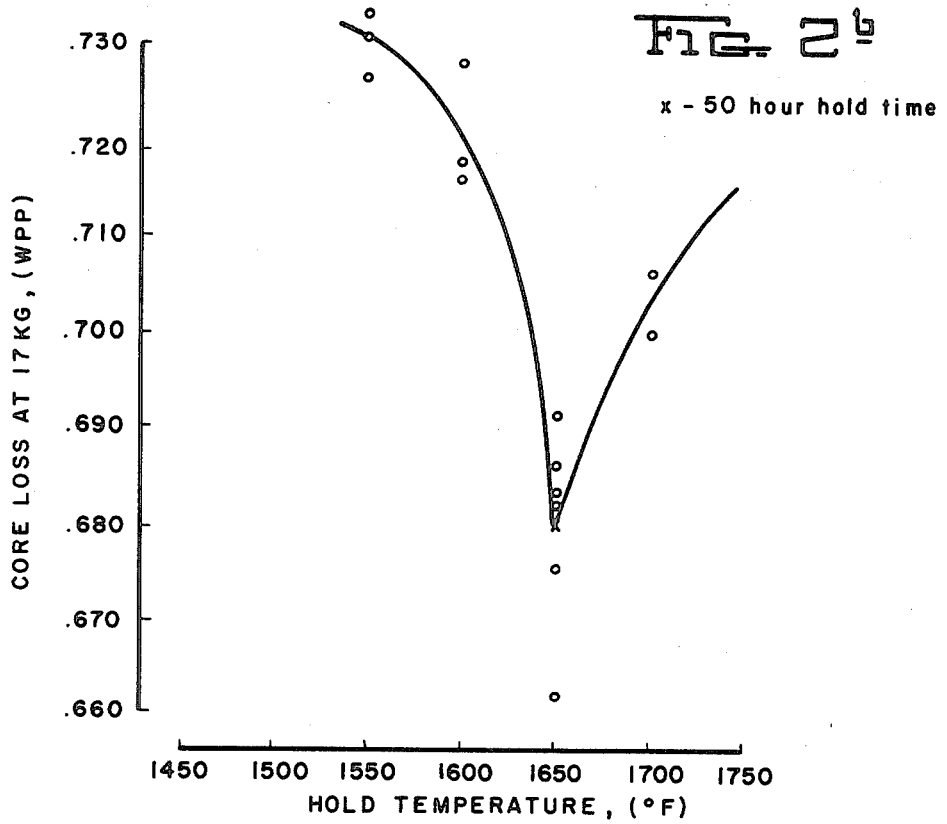

The magnetic properties listed in Table II represent an average value for core loss and permeability for the number of samples for that group. The distribution of 60 Hz core losses at 17 KG (1.7 Tesla) and permeability at 10 Oersteds for those samples are shown in FIGS. 2a and 2b.

The data show that for 9-mil gauge, as with the 11-mil gauge, the annealed samples were incompletely recrystallized at 1550° F., but completely recrystallized at about 1650° F. hold temperature. The data also suggest that within the 1600°–1700° F. range, there may be a range of temperatures within which substantial recrystallization occurs with a corresponding improvement in magnetic properties. The range of about 1650°–1700° F. is preferred and is slightly higher than the range for the thicker, 11-mil steel.

The data also confirm that the hold times for the isothermal anneal are critical. As with the 11-mil data, the 9-mil samples demonstrate some deterioration of magnetic properties at 50 hours hold time, as shown by Groups H, I and J. Groups H and J show such poor properties that they are not plotted in FIGS. 2a and 2b. It appears that the thin gauge 9-mil material is even more sensitive to hold times than the 11-mil material. Results of tests have shown that hold times up to 20 hours provide good results, preferably 6 to 20 hours, and a practical preferred time of about 12 hours.

The overall results show that a dramatic improvement in overall magnetic properties of core loss and permeability result from both 9-mil and 11-mil steel when processed by an isothermal anneal for 6–20 hours within the range 1600°–1700° F. The preferred ranges for each differ within that range, but the best combination of properties and complete secondary recrystallization occurs at about 1650° F. for both gauges.

The method of the present invention relates to an improved final texture annealing process wherein the steel is heated to a recrystallization temperature within the range of 1600° to 1700° F. The heating rate may be on the order of a conventional 50° F. per hour and the selected isothermal hold temperature be about 1650° F. The steel is then isothermally heated by holding the steel at that temperature for about 6 to 20 hours, preferably about 12 hours, to substantially complete secondary recrystallization. Thereafter the steel is heated from that temperature to a purification temperature in excess of 2000° F., preferably about 2200° F., at a heating rate such as 50° F. per hour and held at that temperature to effect purification. Generally, the heating rate up to the hold temperature and up to the purification temperature are relatively constant heating rates. The heating rate, however, does not appear to be critical to significantly affect the properties.

An advantage of the method of the present invention is that secondary recrystallization is essentially completed during the isothermal portion of the heat treatment, rather than being completed in accordance with conventional practice during heating to the higher purification temperature. As has been demonstrated, the effect of the present invention is to improve both magnetic permeability and core loss values. The method of the present invention is able to improve the magnetic properties in a manner not heretofore recognized in the art.

Although preferred and alternative embodiments have been described, it will be apparent to one skilled in the art that changes can be made therein without departing from the scope of the invention.

What is claimed is:

1. In a process for producing electromagnetic silicon steel having a cube-on-edge orientation, which process includes the steps of preparing a steel melt containing 2.5 to 4% silicon, casting the steel, hot rolling the steel, cold rolling the steel to final gauge, decarburizing the steel, applying a refractory oxide base coating to the steel, and final texture annealing the steel by heating to and maintaining a temperature in excess of 2000° F., the improvement comprising the steps of during final texture annealing, heating the steel to a recrystallization temperature within the range of 1600° to 1700° F.;

heating the steel at about 10° F./hour or less in the recrystallization temperature range at temperatures depending upon the thickness of the steel with higher temperatures for thinner steel for about 6 to 20 hours to substantially complete secondary recrystallization; and heating the steel from the selected recrystallization temperature range to a temperature in excess of the 2000° F., said steel having improved magnetic permeability and core loss values.

2. The process as set forth in claim 1 wherein the recrystallization temperature range is about 1600° to 1650° F. for steel having a gauge of about 11 mils.

3. The process as set forth in claim 1 wherein the recrystallization temperature range is about 1650° to 1700° F. for steel having a gauge of about 9 mils.

4. The process as set forth in claim 1 wherein the steel is substantially isothermally heated at about 1650° F. for about 12 hours.

5. The process as set forth in claim 1 wherein the heating in the recrystallization temperature range occurs at about 5° F./hour or less.

6. In a process for producing electromagnetic silicon steel having a cube-on-edge orientation, which process includes the steps of preparing a steel melt containing 2.5 to 4% silicon, casting the steel, hot rolling the steel, cold rolling the steel to final gauge, decarburizing the steel, applying a refractory oxide base coating to the steel, and final texture annealing the steel by heating to and maintaining at a temperature in excess of 2000° F., the improvement comprising heating the steel during final texture annealing at a relatively constant heating rate to about 1600°-1700° F.;

substantially isothermally heating the steel at about 1600°-1650° F. for steel having a gauge of about 11 mils, and about 1650°-1700° F. for thinner steel for about 6 to 20 hours to substantially complete secondary recrystallization; and then heating the steel at a relatively constant heating rate to a temperature in excess of the 2000° F., said steel having improved magnetic permeability and core loss values.

7. A process for producing electromagnetic silicon steel having a cube-on-edge orientation comprising the steps of preparing a steel melt containing 2.5 to 4% silicon; casting the steel; hot rolling the steel; cold rolling the steel to final gauge, decarburizing the steel; applying a refractory oxide base coating to the steel; heating the coated steel to a recrystallization temperature range of 1600° to 1700° F.; heating the steel at about 10° F./hour or less in the recrystallization temperature range at temperatures depending upon the thickness of the steel, and being about 1650° F. or more for steels having a gauge of 11 mils or thinner for about 6 to 20 hours to substantially complete secondary recrystallization; and thereafter to complete final texture annealing, further heating the steel from the selected recrystallization temperature range to a temperature in excess of 2000° F., said steel having improved magnetic permeability and core loss values.

8. The process as set forth in claim 7 wherein the recrystallization temperature range is about 1600° to 1650° F. for steel having a gauge of about 11 mils.

9. The process as set forth in claim 7 wherein the recrystallization temperature range is about 1650° to 1700° F. for steel having a gauge of about 9 mils.

10. The process as set forth in claim 7 wherein the steel is substantially isothermally heated at about 1650° F. for about 12 hours.

11. The process as set forth in claim 7 wherein the steel is heated at about 5° F./hour or less.

* * * * *